US010497224B2

(12) United States Patent
Lee

(10) Patent No.: US 10,497,224 B2
(45) Date of Patent: Dec. 3, 2019

(54) SAFETY MANAGEMENT SYSTEM FOR WORKER AT TUNNEL CONSTRUCTION SITE

(71) Applicant: GSIL CO., LTD., Gyeonggi-do (KR)

(72) Inventor: Jung Woo Lee, Seoul (KR)

(73) Assignee: GSIL CO., LTD., Gyeonggi-do (KR)

( * ) Notice: Subject to any disclaimer, the term of this patent is extended or adjusted under 35 U.S.C. 154(b) by 0 days.

(21) Appl. No.: 16/084,552

(22) PCT Filed: Oct. 24, 2016

(86) PCT No.: PCT/KR2016/011951
§ 371 (c)(1),
(2) Date: Sep. 12, 2018

(87) PCT Pub. No.: WO2017/159946
PCT Pub. Date: Sep. 21, 2017

(65) Prior Publication Data

US 2019/0080565 A1 Mar. 14, 2019

(30) Foreign Application Priority Data

Mar. 17, 2016 (KR) ..... 10-2016-0032080
Aug. 31, 2016 (KR) ..... 10-2016-0111462

(51) Int. Cl.
*G08B 3/10* (2006.01)
*G08B 21/04* (2006.01)
(Continued)

(52) U.S. Cl.
CPC ..... *G08B 3/10* (2013.01); *G08B 5/36* (2013.01); *G08B 21/043* (2013.01);
(Continued)

(58) Field of Classification Search
CPC ..... G08B 3/10; G08B 21/02; G08B 21/0407; G08B 21/0469
(Continued)

(56) References Cited

U.S. PATENT DOCUMENTS 3,751,929 A * 8/1973 Bernold ..... E01C 3/006 405/150.1
6,554,368 B2 * 4/2003 Drake ..... E21B 7/002 299/1.3
(Continued)

FOREIGN PATENT DOCUMENTS

KR JP2008-192096 8/2008
KR 10-1166075 7/2012
(Continued)

*Primary Examiner* — John A Tweel, Jr.
(74) *Attorney, Agent, or Firm* — Wells St. John P.S.

(57) ABSTRACT

Disclosed is a safety management system for a worker at a tunnel construction site, the system comprising: a server for controlling the safety management system; routers installed at predetermined intervals at the tunnel construction site; a worker terminal carried by the worker; and at least one information collecting terminal for receiving worker information from the worker terminal and collecting environment information of the tunnel construction site so as to transfer the same to the server, wherein the server determines a location of the worker by using the worker information; divides a map of the tunnel construction site into a plurality of zones and displays the same on a browser; displays the worker information on a zone where the worker is located, among the plurality of zones; and determines at least one danger zone on the basis of the environment information and previously input risk factors.

9 Claims, 7 Drawing Sheets

(51) Int. Cl.
*G08B 5/36* (2006.01)
*G08B 25/01* (2006.01)
*G08B 21/14* (2006.01)

(52) U.S. Cl.
CPC ..... *G08B 21/0407* (2013.01); *G08B 21/0461* (2013.01); *G08B 21/0469* (2013.01); *G08B 21/0476* (2013.01); *G08B 21/0492* (2013.01); *G08B 25/016* (2013.01); *G08B 21/14* (2013.01)

(58) Field of Classification Search
USPC ..... 340/540
See application file for complete search history.

(56) References Cited

U.S. PATENT DOCUMENTS

| | | | | |
|---|---|---|---|---|
| 6,708,085 | B2 * | 3/2004 | Yamane | G08G 1/0104 340/905 |
| 2005/0039931 | A1 * | 2/2005 | Koerber | A62C 2/10 169/64 |
| 2017/0303187 | A1 * | 10/2017 | Crouthamel | H04W 4/80 |

FOREIGN PATENT DOCUMENTS

| | | |
|---|---|---|
| KR | 10-2012-0096977 | 9/2012 |
| KR | 10-2014-0115662 | 10/2014 |
| KR | 10-1485257 | 1/2015 |

* cited by examiner

SAFETY MANAGEMENT SYSTEM FOR WORKER AT TUNNEL CONSTRUCTION SITE

CROSS REFERENCE TO RELATED APPLICATION

This is a 35 U.S.C. § 371 application of, and claims priority to, International Application No. PCT/KR2016/011951, which was filed on Oct. 24, 2016, and claims priority to Korean Patent Application No. 10-2016-0111462, which was filed on Aug. 31, 2016, and which claims priority to Korean Patent Application No. 10-2016-0032080, which was filed on Mar. 17, 2016, the teachings of all the applications are incorporated herein by reference.

TECHNICAL FIELD

The present invention relates to a safety management system for a worker at a tunnel construction site.

BACKGROUND ART

Recently, tunnel construction for forming tunnels by mechanically digging up and/or boring a base rock or the soil has been carried out at several places in order to use the tunnels for transportation for roads, railways, subways, and underground passages, watercourses for water supply and water use (irrigation, power generation, and water supply and sewage), transportation and underground storage of oil, underground pipe utility conduits for communication and electricity, underground storage of nuclear waste, mines, and military facilities.

Since such tunnel construction is very dangerous work, large and small accidents occur due to the blasting of explosives, occurrence of fire, or the movement of heavy equipment or the like when tunnel construction is carried out, and in particular, accidents affecting unauthorized laborers or foreign workers frequently occur in tunnels. To date, those in charge of safety in tunnel construction have made efforts to prevent accidents from occurring by detecting the locations of workers in a tunnel, the presence or absence of workers in a danger zone in blasting, and the entry and exit of an unauthorized worker. However, no suitable alternative plan, other than a method in which a person in charge of safety personally and visually checks such a situation, is present, because communication is not facilitated in the tunnel.

Therefore, there has emerged significant need for a system that is capable of detecting the locations of workers in a tunnel to prevent the occurrence of accidents in tunnel construction and a system that is capable of determining the last location of each worker to secure the golden time for rescue when an accident has occurred.

DISCLOSURE

Technical Problem

An object of the present invention to be solved is to provide a safety management system for a worker at a tunnel construction site.

Objects of the present invention to be solved are not limited to the above-described object, and other objects, not described here, will be more clearly understood by those skilled in the art from the following detailed descriptions.

Technical Solution

A safety management system for a worker at a tunnel construction site in accordance with an aspect of the present invention to accomplish the above object includes a server configured to control the safety management system, routers installed at regular intervals at the tunnel construction site, a worker terminal carried by the worker, and one or more information collection terminals configured to receive worker information from the worker terminal, collect environmental information of the tunnel construction site, and transfer the environmental information to the server, wherein the server determines a location of the worker using the worker information, divides a map of the tunnel construction site into multiple areas, displays the multiple areas on a browser, displays the worker information in an area in which the worker is located, among the multiple areas, and sets at least one danger zone based on the environmental information and previously input risk factors.

Advantageous Effects

Since communication with the outside is difficult at a tunnel construction site, there are many difficulties in safety management within the construction site. In accordance with disclosed embodiments, there are advantages in that the management of the arrival and departure of workers and the registration of use of equipment may be automated, and then the construction site may be conveniently managed. Further, since the locations of workers within the tunnel construction site can be determined, work management may be facilitated, and workers may be rapidly rescued in the event of an emergency.

Further, since an environment in a tunnel and the occurrence or non-occurrence of accidents in the tunnel can be monitored by utilizing information collection terminals, which are installed at predetermined intervals, and worker terminals, which can be carried by respective workers, there are advantages in that accidents may be prevented and in that actions may be rapidly taken in the event of accidents. Furthermore, a danger zone in a tunnel may be determined using big data, and a warning may be provided to workers so that they can escape from the danger zone.

In addition, there are advantages in that details of whether workers wear safety equipment, whether the workers are using authorized equipment, whether the workers enter and exit from a danger zone, and whether the workers arrive and depart on time are recorded, so that whether the workers comply with safety regulations may be monitored, thus preventing the occurrence of accidents caused by failure to comply with safety regulations.

The advantages of the present invention are not limited to the above-described advantages, and other advantages, not described here, will be clearly understood by those skilled in the art from the following descriptions.

BEST MODE

Figure 1:
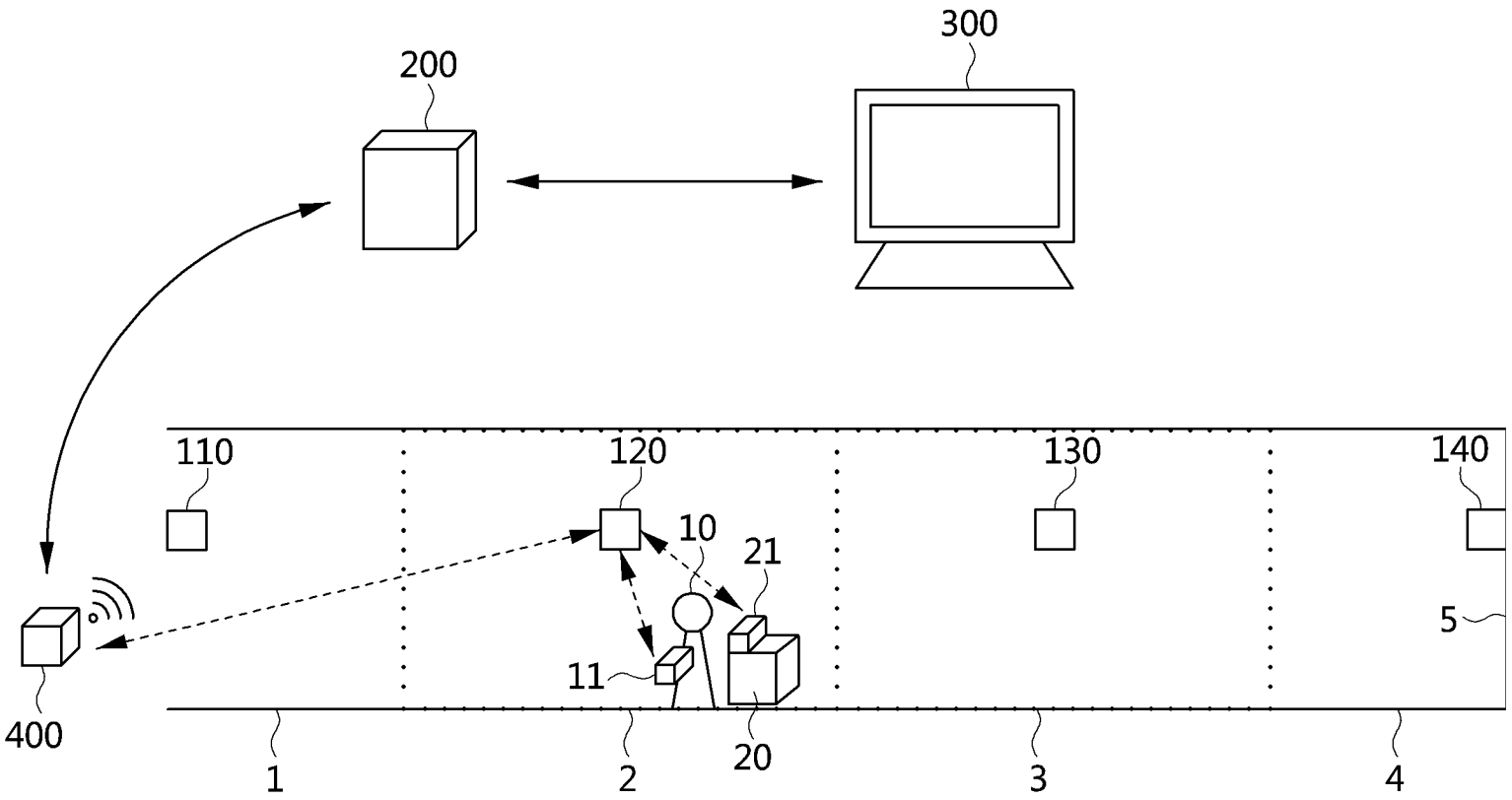
FIG. 1 is a diagram illustrating a safety management system for a worker at a tunnel construction site according to an embodiment.

A safety management system for a worker at a tunnel construction site in accordance with an aspect of the present invention to accomplish the above object includes a server configured to control the safety management system, routers installed at regular intervals at the tunnel construction site, a worker terminal carried by the worker, and one or more information collection terminals configured to receive worker information from the worker terminal, collect environmental information of the tunnel construction site, and transfer the environmental information to the server, wherein the server determines a location of the worker using the worker information, divides a map of the tunnel construction site into multiple areas, displays the multiple areas on a browser, displays the worker information in an area in which the worker is located, among the multiple areas, and sets at least one danger zone based on the environmental information and previously input risk factors.

Further, the one or more information collection terminals may be installed at predetermined intervals from an entrance of the tunnel construction site to a blind-end face of the tunnel construction site, and may be additionally installed between the predetermined intervals when a tunnel face of the tunnel construction site or an obstacle is located between the predetermined intervals.

Furthermore, the server may divide the map of the tunnel construction site into multiple areas around the one or more information collection terminals, display the multiple areas on the browser, and display the worker information in an area around the information collection terminal that has received the worker information, among the multiple areas.

Furthermore, the safety management system may further include a manager terminal carried by a safety manager of the tunnel construction site, wherein the manager terminal may display the browser.

Furthermore, the safety management system may further include an equipment terminal carried by equipment used for tunnel construction, wherein the one or more information collection terminals may receive equipment information from the equipment terminal and transfer the equipment information to the server, and wherein the server may determine a location of the equipment using the equipment information and generate information about equipment being used by the worker using the location of the worker and the location of the equipment.

Furthermore, the server may be configured to determine an arrival time of the worker and a departure time of the worker using worker information received by an information collection terminal installed at an entrance of the tunnel construction site, and determine a start time and an end time of use of the equipment using equipment information received by the information collection terminal installed at the entrance of the tunnel construction site.

Furthermore, the server may be configured to determine, using information about the equipment being used by the worker, whether the worker wears safety equipment and whether the worker using the equipment is authorized to use the equipment, determine whether the worker enters and exits the danger zone, and determine whether the worker complies with safety regulations based on the arrival time and the departure time of the worker and determination of whether the worker wears the safety equipment, whether the worker is authorized to use the equipment, and whether the worker enters and exits the danger zone.

Furthermore, the server may be configured to update, in real time, information about the at least one set danger zone using the environmental information, the worker information, and information about accidents or problems occurring in each of the multiple areas.

Furthermore, the server may be configured to, when it is not possible to determine the location of the worker, determine a last area in which the worker was located, among the multiple areas, generate and display a new area adjacent to the last area in which the worker was located, and display the worker information in the new area.

In addition, the worker terminal may further include a short-range communication module that enables communication between individual worker terminals, and may transfer information about one or more nearby workers, received by the short-range communication module, to a corresponding information collection terminal, and the server may generate a group including the worker and one or more additional workers located near the worker using the information about the one or more nearby workers, received by the short-range communication module, and determine locations of the one or more additional workers belonging to the group based on the location of the worker and the information about the one or more nearby workers.

Other details will be included in the following detailed description and drawings.

MODE FOR INVENTION

The advantages and features of the present invention and methods for achieving them will be more clearly understood from the following embodiments which will be described in detail in conjunction with the accompanying drawings. However, the present invention may be implemented in various forms without being limited to the following embodiments, the present embodiments are merely provided to enable those skilled in the art to which the present invention pertains to completely understand the disclosure of the present invention, and the present invention is merely defined by the accompanying claims of the present invention.

The terms used in the present specification are merely used to describe embodiments and are not intended to limit the present invention. In the present specification, a singular expression includes a plural expression unless a description to the contrary is specifically pointed out in context. Terms such as "comprises" and/or "comprising" used in the specification do not exclude the existence or addition of one or more other components. It should be noted that the same reference numerals are used to designate the same components throughout the specification, and "and/or" may include any one of, or a combination of, the components mentioned. Terms such as "first" and "second" may be used to describe various components, but it is apparent that the various components are not limited by the terms. Those terms are only used for the purpose of differentiating a component from other components. Therefore, it is apparent that a first component which will be described below may be referred to as a second component without departing from the technical spirit of the present invention.

Unless otherwise defined, all terms (including technical and scientific terms) used herein have the same meanings as those commonly understood by one skilled in the art to which this invention pertains. It will be further understood that terms, such as those defined in commonly used dictionaries, should not be interpreted in an idealized or overly formal sense unless expressly so defined herein.

Hereinafter, embodiments of the present invention will be described in detail with reference to the attached drawings.

FIG. 1 is a diagram illustrating a safety management system for a worker at a tunnel construction site according to an embodiment.

Referring to FIG. 1, at a tunnel construction site, routers 400 may be installed at regular intervals. In an embodiment, the routers 400 may be Wi-Fi wireless routers. The routers 400 may be installed at the entrance of the tunnel construction site.

The worker 10 of the tunnel construction site may carry a worker terminal 11. In an embodiment, the worker terminal 11 may be attached to a safety helmet worn by the worker 10.

The worker 10 may use equipment 20 for tunnel construction. In an embodiment, an equipment terminal 21 may be attached to the equipment 20. In an embodiment, the worker terminal 11 and the equipment terminal 21 may be Bluetooth Low Energy (BLE) beacons. Since such a BLE beacon has very low power consumption, the operation of a system is possible for a period of six months to one year when the BLE beacon is charged once, and the system may be maintained by charging a battery using a smartphone even in the case of frequent power failures at the tunnel construction site.

In another embodiment, the worker terminal 11 and the equipment terminal 21 may use a dedicated Internet of Things (IoT) network. For example, the worker terminal 11 and the equipment terminal 21 may use Long-term Evolution for Machines (LTE-M) or a Long-Range Wide Area Network (LoRaWAN). The communication methods that can be used by the worker terminal 11 and the equipment terminal 21 are not limited thereto.

In an embodiment, the worker terminal 11 may further include a component for performing an emergency bell function and an emergency call function. In other embodiments, the worker terminal 11 may be operated in conjunction with an application installed in the smartphone or personal terminal of the worker 10, and the smartphone or the personal terminal of the worker 10 may also provide an emergency bell function and an emergency call function. In an embodiment, the worker 10 may send a rescue signal using the worker terminal 11.

In an embodiment, the worker terminal 11 may include an acceleration sensor or a gyro sensor for sensing the motion of the worker 10. The worker terminal 11 may transmit information about the motion of the worker 10 to an information collection terminal 120. In other embodiments, the worker terminal 11 may be operated in conjunction with the smartphone or the personal terminal of the worker 10, and may transmit information about the motion of the worker 10, received from the acceleration sensor or the gyro sensor provided on the smartphone or the personal terminal of the worker 10, to the information collection terminal 120. In a further embodiment, information about the motion of the worker 10, received from the acceleration sensor or the gyro sensor provided on the smartphone or the personal terminal of the worker 10, may be transmitted to a server 200 through the corresponding router 400.

In an embodiment, the worker terminal 11 may include a sensor for measuring the heart rate or the pulse of the worker 10. Further, the worker terminal 11 may include at least one sensor for collecting information about the environment surrounding the worker 10. For example, the worker terminal 11 may include at least one sensor for sensing the concentration of oxygen in the air, the concentration of carbon dioxide in the air, the leakage of harmful gas, the ambient temperature, humidity, the presence of surrounding objects, or the like. The type of sensor that can be provided on the worker terminal 11 is not limited. The worker terminal 11 may transmit the information collected by the sensor to the information collection terminal 120.

In an embodiment, the safety manager of the tunnel construction site may carry a manager terminal. The safety manager of the tunnel construction site may refer to a worker who takes charge of safety management work, among the workers 10 of the tunnel construction site. The manager terminal may be configured in a manner similar to that of the worker terminal 11. In other embodiments, the safety manager may also carry a worker terminal 11, and may carry a manager terminal separately from the worker terminal 11. In an embodiment, the manager terminal may be the smartphone or the Personal Computer (PC) of the manager.

Also, at the tunnel construction site, information collection terminals 110 to 140 may be installed at predetermined intervals from the entrance of the tunnel construction site to a blind-end face 5. In an embodiment, when a tunnel face or an obstacle is interposed between the predetermined intervals, an information collection terminal may be additionally installed between the predetermined intervals. In an embodiment, the information collection terminals 110 to 140 may be installed at arbitrary intervals.

In an embodiment, each of the information collection terminals 110 to 140 may include a BLE beacon scanner. In other embodiments, each of the information collection terminals 110 to 140 may use a dedicated IoT network. For example, the worker terminal 11 and the equipment terminal 21 may use an LTE-M or Long-Range Wide Area Network (LoRaWAN).

In an embodiment, the tunnel construction site may be divided into multiple areas depending on the locations and signal reception ranges of respective information collection terminals 110 to 140. For example, the tunnel construction site may be divided into a first area 1 corresponding to the signal reception range of the information collection terminal 110, a second area 2 corresponding to the signal reception range of the information collection terminal 120, a third area 3 corresponding to the signal reception range of the information collection terminal 130, and a fourth area 4 corresponding to the signal reception range of the information collection terminal 140.

The information collection terminals 110 to 140 may communicate with the outside using the router 400. In an embodiment, the information collection terminals 110 to 140 may receive information from each worker terminal and each equipment terminal, and may transmit the received information to the server 200 through the router 400.

For example, the worker 10 and the equipment 20 may be located in the second area 2, corresponding to the signal reception range of the information collection terminal 120. The information collection terminal 120 may receive signals from the worker terminal 11 of the worker 10 and the equipment terminal 21 of the equipment 20. The information collection terminal 120 may acquire information included in signals received from the worker terminal 11 and the equipment terminal 21. The information collection terminal 120 may transmit the acquired information to the server 200 through the router 400.

In an embodiment, each of the information collection terminals 110 to 140 may include at least one sensor that is capable of collecting information about the surrounding environment. For example, each of the information collection terminals 110 to 140 may include at least one sensor for sensing the concentration of oxygen in the air, the concentration of carbon dioxide in the air, the leakage of harmful gas, the ambient temperature or humidity. The type of sensor that can be provided in each of the information collection terminals 110 to 140 is not limited. Each of the information collection terminals 110 to 140 may transmit the information collected by the sensor to the server 200 through the router 400.

In an embodiment, each of the information collection terminals 110 to 140 may further include a component for sensing, tracking and classifying surrounding objects or moving objects. For example, each of the information collection terminals 110 to 140 may include at least one sensor for sensing surrounding objects or moving objects. Each of the information collection terminals 110 to 140 may further include a camera that is capable of tracking and capturing moving objects.

Each of the information collection terminals 110 to 140 may classify surrounding objects or moving objects using information received from the corresponding sensor or information captured by the corresponding camera. In an embodiment, each of the information collection terminals 110 to 140 may transmit the information received from the corresponding sensor or information captured by the corresponding camera to the server 200 through the router 400. The server 200 may classify objects surrounding the information collection terminals 110 to 140 or moving objects using the received information.

In an embodiment, the server 200 may check the states of the connection between the information collection terminals 110 to 140 and the router 400. For example, when the router 400 is installed at the entrance of the tunnel construction site, the server 200 may sequentially check the states of the connection to the router 400, with respect to information collection terminals ranging from the information collection terminal 110 located at the entrance of the tunnel construction site or located closest to the entrance of the tunnel construction site to the information collection terminal 140 located at the blind-end face 5 or located closest to the blind-end face 5.

When an information collection terminal having a bad state of connection to the router 400 is detected, the server 200 may transmit information about the area corresponding to the information collection terminal having the bad connection state. In an embodiment, a new router or a Wi-Fi signal repeater may be installed in the area corresponding to the information collection terminal having the bad connection state or in at least one of areas interposed between the area corresponding to the information collection terminal having the bad connection state and the repeater 400.

Referring to FIG. 1, the safety management system for a worker at a tunnel construction site may further include a display device 300. The display device 300 may display information processed by the server 200. In an embodiment, the display device 300 may display a browser.

In an embodiment, the server 200 may display a map of the tunnel construction site on the browser. The server 200 may divide the map of the tunnel construction site into multiple areas, display the multiple areas on the browser, and display information about the worker 10 in the area in which the worker 10 is located among the multiple areas. Further, the server 200 may display information about a danger zone on the map of the tunnel construction site displayed on the browser.

Similarly, the display device 300 may display the map of the tunnel construction site. The display device 300 may display multiple areas 1 to 4 resulting from division in accordance with the locations and signal reception ranges of respective information collection terminals 110 to 140. The display device 300 may display information about workers respectively located in the multiple areas resulting from division. In addition, the display device 300 may display a danger zone, among the multiple areas resulting from division.

In an embodiment, the display device 300 may be a monitor connected to the server 200 in a wired or wireless manner. In other embodiments, the display device 300 may be a terminal that is capable of displaying information received from the server 200. For example, the display device 300 may be a smartphone carried by the worker 10. The worker 10 may check information about the tunnel construction site using the smartphone. In this case, the smartphone of the worker 10 may receive information from the server 200 through the router 400.

Figure 2:
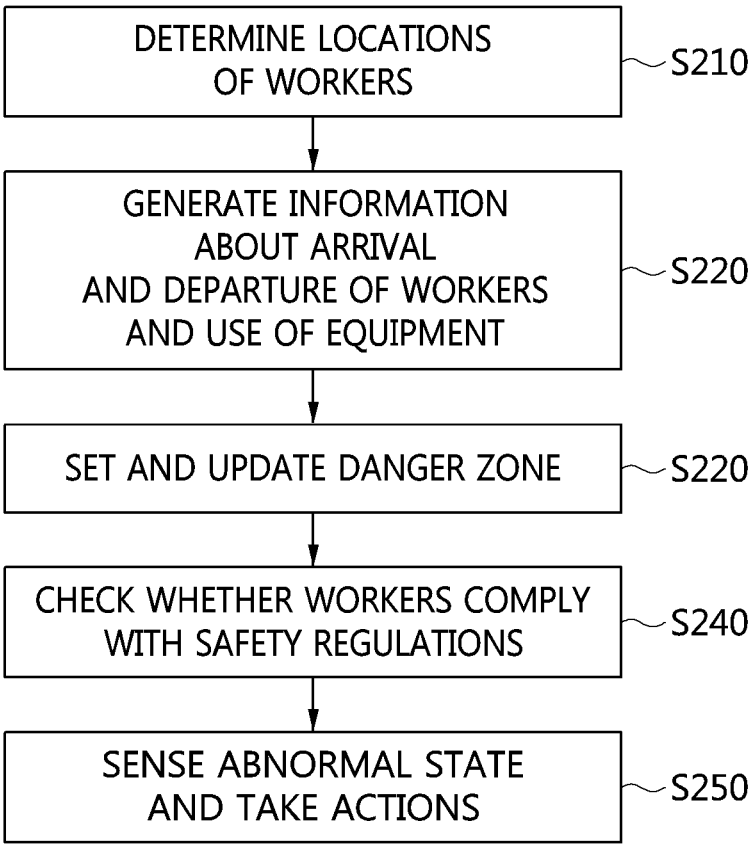
FIG. 2 is a flowchart illustrating the operation of a server for operating a safety management system for a worker at a tunnel construction site according to an embodiment.

FIG. 2 is a flowchart illustrating the operation of a server for operating a safety management system for a worker at a tunnel construction site according to an embodiment.

At step S210, the server 200 may determine the locations of workers at the tunnel construction site. The server 200 may determine the locations of respective workers based on the locations of information collection terminals which receive respective pieces of information from the worker terminals. For example, when a signal from the worker terminal 11 of a worker 10 is received by the information collection terminal 120, the server 200 may determine whether the worker 10 is present in the second area 2.

Further, the server 200 may determine the location of the worker 10 in the second area 2 using the strength of the signal from the worker terminal of the worker 10, received by the information collection terminal 120. In an embodiment, the server 200 may determine the detailed location of the worker 10 using the direction of the received signal or the strength of the signal from the worker terminal 11 of the worker 10, which is received by the neighboring information collection terminals 110 and 130.

At step S220, the server 200 may manage information about the arrival and departure of workers at and from the tunnel construction site and information about pieces of equipment used at the tunnel construction site.

In an embodiment, the server 200 may manage the arrival and departure of the workers at and from the tunnel construction site using information that is received by the information collection terminal 110 that is installed at the entrance of the tunnel construction site or is installed closer to the entrance of the tunnel construction site. There are many cases where a check on the arrival and departure of workers at and from the tunnel construction site is overlooked. In accordance with the disclosed embodiment, a list of workers who are working at the tunnel construction site may be efficiently managed. Therefore, information about whether workers arrive at and depart from the construction site and the arrival and departure times of the workers may be easily managed. Similarly, the number of workers who are present at the tunnel construction site and information about the identities of the workers may be easily acquired in the event of an emergency.

In an embodiment, the server 200 may acquire information about workers who pass through the entrance of the tunnel construction site using the information collection terminal 110. Also, the server 200 may acquire information about the movement directions of the workers who pass through the entrance of the tunnel construction site using the information collection terminal 110. In an embodiment, the server 200 may acquire information about the movement directions of workers who pass through the entrance of the tunnel construction site using the information collection terminals 110 and 120. Therefore, the server 200 may determine, based on the movement directions of the workers, whether the workers arrive at or depart from the tunnel construction site.

The server 200 may determine the locations of pieces of equipment used at the tunnel construction site. The server 200 may determine the locations of respective pieces of equipment based on the locations of the information collection terminals that receive pieces of information from respective equipment terminals. For example, when a signal from the equipment terminal 21 of equipment 20 is received by the information collection terminal 120, the server 200 may determine that the equipment 20 is located in the second area 2.

Furthermore, the server 200 may determine the location of equipment 20 in the second area 2 using the strength of the signal from the equipment terminal 21 of the equipment 20, received by the information collection terminal 120. In an embodiment, the server 200 may determine the detailed location of the equipment 20 using the direction of the received signal or the strength of the signal from the equipment terminal 21 of the equipment 20, received by the neighboring information collection terminals 110 and 130.

In an embodiment, the server 200 may manage the usage states of pieces of equipment using information which is received by the information collection terminal 110 that is installed at the entrance of the tunnel construction site or is installed closer to the entrance of the tunnel construction site. At the tunnel construction site, there are many cases where the usage of equipment is not correctly accounted for. In accordance with the disclosed embodiment, the list of pieces of equipment that are currently being used at the tunnel construction site may be efficiently managed.

In an embodiment, the server 200 may acquire information about pieces of equipment that pass through the entrance of the tunnel construction site using the information collection terminal 110. Further, the server 200 may acquire information about the movement directions of pieces of equipment that pass through the entrance of the tunnel construction site using the information collection terminal 110. In an embodiment, the server 200 may acquire information about the movement directions of pieces of equipment that pass through the entrance of the tunnel construction site using the information collection terminals 110 and 120. Therefore, the server 200 may determine, based on the movement directions of the pieces of equipment, whether the pieces of equipment are being used and whether the use of the pieces of equipment has been completed.

Also, the server 200 may acquire information about pieces of equipment that are used by respective workers based on the locations of the workers and the locations of pieces of equipment. For example, when a worker 10 and equipment 20 are found to be located either at the same location or closer to each other, it may be determined that the worker 10 is using the equipment 20. Further, when the worker 10 and the equipment 20 are found to simultaneously pass through the entrance of the tunnel construction site, it may be determined that the worker 10 is wearing or using the equipment 20.

The server 200 may determine, based on the locations of workers and the locations of pieces of equipment, whether each worker wears safety equipment. For example, unless a signal from the equipment terminal of safety equipment to be worn by the worker is received from the place where the signal from the worker terminal of the worker is received, it may be determined that the worker is not wearing the required safety equipment.

Further, the server 200 may determine whether workers use authorized equipment. For example, when a signal from the equipment terminal 21 of the equipment 20 is received from the place where the signal from the worker terminal 11 of the worker 10 is received, the server 200 may determine the type of the equipment 20. When special qualification or authorization is needed to use the equipment 20, the server 200 may determine whether the worker 10 possesses the qualification or authorization to use the equipment 20. If it is determined that the worker 10 does not possess the qualification or authorization to use the equipment 20, the server 200 may send a warning message to the worker 10, to the manager terminal of the safety manager or to the worker terminals of other workers.

At step S230, the server 200 may set a danger zone, among the multiple areas of the tunnel construction site. The server 200 may generate a list of danger zones including at least one of the multiple areas, based on information about the surrounding environment, collected from the information collection terminals 110 to 140 of the tunnel construction site, and information about previously input risk factors.

For example, the server 200 may set an area having a low oxygen concentration or a high carbon dioxide concentration as a danger zone based on the information about the surrounding environment collected from the information collection terminals 110 to 140. Further, the server 200 may set an area in which a dangerous lithological structure or subterranean water is detected as a danger zone based on the results of boring investigation conducted before a tunnel is dug.

In an embodiment, the server 200 may update the list of danger zones in real time using the information about the surrounding environment, received from the information collection terminals 110 to 140, information about workers respectively located in the multiple areas of the tunnel construction site, and information about accidents or problems respectively occurring in the multiple areas.

For example, the server 200 may generate information about a change in the surrounding environment of each area by accumulating the information about the surrounding environment, received from the information collection terminals 110 to 140. The server 200 may predict the change in the surrounding environment of each area based on the generated information.

Further, the server 200 may generate information about accident records of respective areas by accumulating information about accidents that occur in respective areas. The server 200 may generate information about accidents frequently occurring in respective areas based on the generated information.

The server 200 may update the information about the danger zone in real time based on information about the change in the surrounding environment of each area and information about accidents frequently occurring in each area.

Furthermore, the server 200 may analyze risk factors of each area and provide the results of analysis. The server 200 may determine a problem in each area based on the information about the change in the surrounding environment of each area and the information about accidents frequently occurring in each area. The server 200 may provide information about the problem in each area, and may also provide a means for solving the problem in each area.

In an embodiment, the server 200 may display information about the danger zone using the display device 300. Also, the server 200 may transfer the information about the danger zone to the worker terminal 11 of the worker 10 and the information collection terminals 110 to 140 of the tunnel construction site.

For example, the server 200 may control information collection terminals so that a warning is sent to the worker terminal of a worker who is approaching an information collection terminal located in the danger zone. Further, the server 200 may control information collection terminals so that a warning is provided to the worker terminal of a worker who is located in the danger zone. In an embodiment, each information collection terminal may further include a display unit for displaying information about the danger zone. For example, the information collection terminal located in the danger zone may indicate the location of the danger zone via light or sounds using an emergency light or a speaker included in the display unit. In an embodiment, the server 200 may also send a warning and information about a danger zone to the smartphone of a worker who is approaching the information collection terminal located in the danger zone.

In an embodiment, an application for providing at least one of the location of each worker in a tunnel, the location of equipment, the current state of drilling of the tunnel, the presence or absence of a worker in a danger zone when dangerous work, such as blasting, is conducted, the last location of the corresponding worker when an accident occurs, the presence or absence of harmful gas in the tunnel, and information about a day laborer, who changes every day, may be installed in the mobile terminal or smartphone of the worker. Further, the application installed in the mobile terminal or the smartphone of the worker has a recording (e.g. black-box) function, and thus a worker located near the site of an accident may capture the accident site using his or her smartphone when an accident occurs, and a captured picture or video may be sent to the server 200 so that it can be checked using the manager terminal.

At step S240, the server 200 may check whether the workers of the tunnel construction site comply with safety regulations.

The server 200 may generate information about the arrival and departure times of workers using information about workers who arrive at the tunnel construction site and information about workers who depart from the tunnel construction site.

The server 200 may generate information about whether respective workers wear safety equipment and whether the workers use pieces of equipment authorized to be used based on information about pieces of equipment used by respective workers.

The server 200 may generate information about whether respective workers enter and exit a danger zone using the information about the locations of respective workers.

The server 200 may generate information about whether respective workers comply with safety regulations based on information about the arrival and departure times of respective workers, information about whether the workers wear safety equipment, information about whether the workers use equipment authorized to be used, and information about whether the workers enter and exit the danger zone.

In an embodiment, the server 200 may generate a list of workers who frequently violate safety regulations based on the information about whether the workers comply with the safety regulations. The server 200 may generate information about target workers who need safety education, based on the list of workers who frequently violate the safety regulations.

At step S250, the server 200 may sense an abnormal state, and may take necessary actions when the abnormal state occurs.

In an embodiment, the server 200 may sense the abnormal state of each worker 10 using the information received from the worker terminal 11 of the worker 10. For example, the server 200 may sense a sudden change in the location of the worker terminal 11. In this case, the server 200 may determine that the worker has collapsed or fallen down. Further, the server 200 may determine a state in which the location of the worker terminal 11 does not change for a predetermined period of time. In this case, the server 200 may determine that the corresponding worker has lost consciousness or cannot move due to injury.

When the abnormal state of the worker 10 is sensed, the server 200 may transmit information about the location of the worker 10 and information about the state of the worker 10 to other workers. Also, the server 200 may display information about the location of the worker 10 and the state of the worker 10 on the display device 300.

In an embodiment, each of the information collection terminals 110 to 140 of the tunnel construction site may include a sensor for sensing surrounding objects. For example, each of the information collection terminals 110 to 140 may include an ultrasonic sensor.

In an embodiment, an object may be sensed by the ultrasonic sensor of the corresponding information collection terminal. However, at the location where the object is sensed, a signal from a worker terminal or an equipment terminal may not be received. In this case, the server 200 may determine that an obstacle is present at the corresponding location. The server 200 may transmit information about the obstacle to the workers. Also, the server 200 may display the information about the obstacle on the display device 300.

In an embodiment, when a large number of obstacles are sensed in a region of the tunnel construction site, the server 200 may determine that the tunnel construction site has collapsed. The server 200 may transmit information about a collapsed region to the workers, and may display the information about the collapsed region on the display device 300.

In an embodiment, when an abnormal state is sensed, the server 200 may transfer information about the occurrence of the abnormal state to the workers of the tunnel construction site. Further, the server 200 may transmit information about the occurrence of the abnormal state to the outside thereof. For example, the server 200 may transmit information about the occurrence of the abnormal state to the personal terminal of a rescue worker. The server 200 may transmit information about the location where the abnormal state has occurred to the personal terminal of the rescue worker. Further, when an accident occurs or when an abnormality appears in the health condition of the corresponding worker, the server 200 may transmit information about the location of the worker who has an accident or whose health condition is deteriorated to the personal terminal of the rescue worker.

Figure 3:
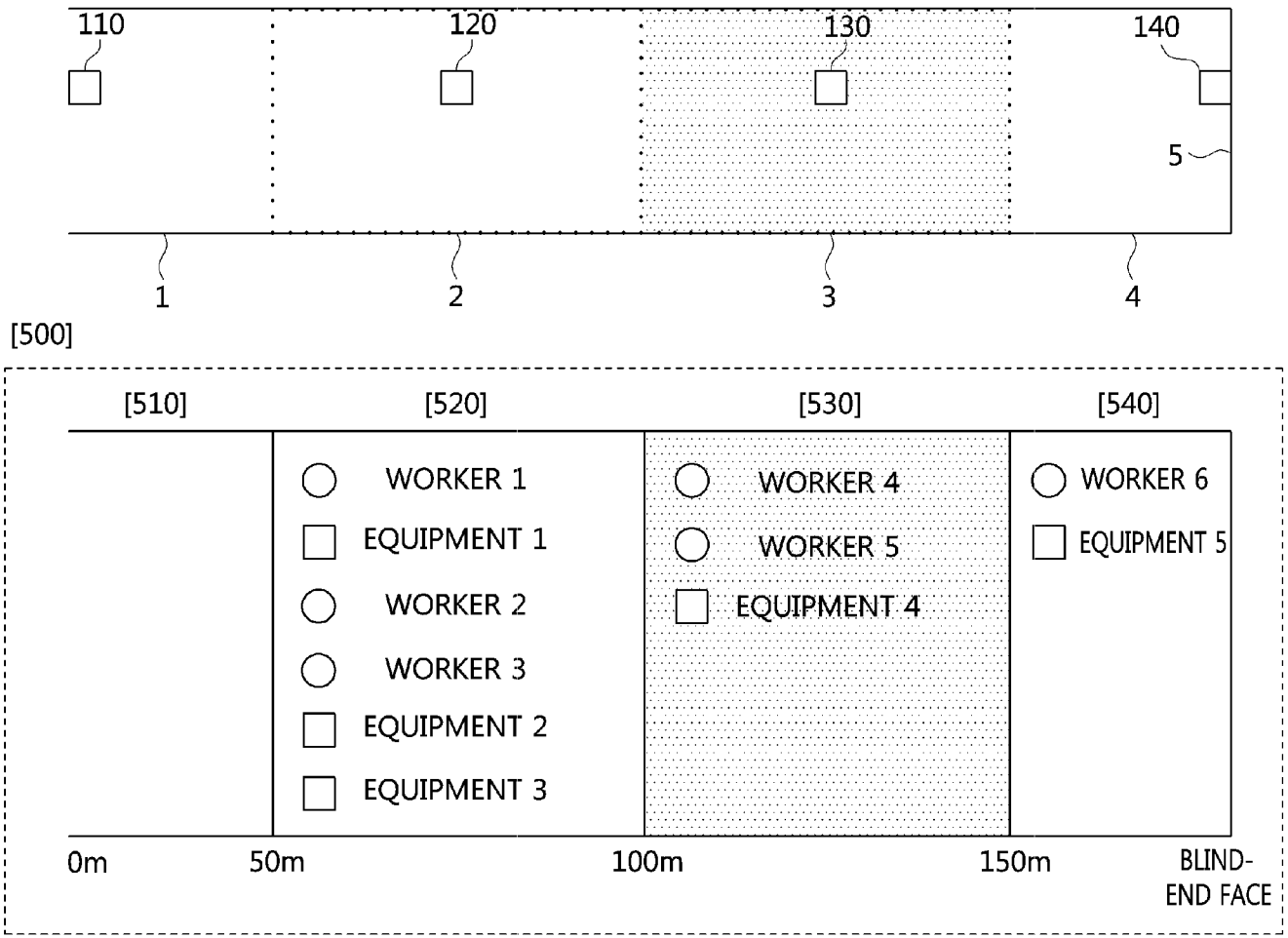
FIG. 3 is a diagram illustrating an example in which the server displays a map of a tunnel construction site.

FIG. 3 is a diagram illustrating an example in which the server displays a map of a tunnel construction site.

In an embodiment, the server 200 may display the map of the tunnel construction site on a browser. The display device 300 may display the map of the tunnel construction site displayed on the browser. The server 200 allows the display device 300 to display the map of the tunnel construction site.

Referring to FIG. 3, a map 500 of a tunnel construction site corresponding to individual areas of the tunnel construction site is depicted. The map 500 of the tunnel construction site may be displayed on the display device 300. For example, the information collection terminals 110 to 140 may be installed at intervals of 100 m from the entrance of the tunnel construction site to a blind-end face 5. In this case, the server 200 may generate multiple areas by dividing the tunnel construction site at locations 50 m to the left and right of each of the information collection terminals 110 to 140.

On the map 500 of the tunnel construction site, multiple areas of the tunnel construction site resulting from the division may be individually displayed. A first area 510 on the map 500 of the tunnel construction site may correspond to the first area 1 of the tunnel construction site. Similarly, a second area 520 to a fourth area 540 on the map 500 of the tunnel construction site may correspond to the second area 2 to the fourth area 4 of the tunnel construction site, respectively.

In each of the multiple areas 510 to 540 indicated on the map 500 of the tunnel construction site, information about workers and pieces of equipment located in the multiple areas 1 to 4 of the tunnel construction site, respectively corresponding to the multiple areas 510 to 540, may be displayed.

For example, when worker 1, worker 2, worker 3, equipment 1, equipment 2, and equipment 3 are located in the second area 2 of the tunnel construction site, information about the worker 1, worker 2, worker 3, equipment 1, equipment 2, and equipment 3 may be displayed in the second area 520 on the map 500 of the tunnel construction site.

Similarly, when worker 4, worker 5, and equipment 4 are located in the third area 3 of the tunnel construction site, information about the worker 4, worker 5, and equipment 4 may be displayed in the third area 530 on the map 500 of the tunnel construction site. Also, when worker 6 and equipment 5 are located in the fourth area 4 of the tunnel construction site, information about the worker 6 and equipment 5 may be displayed in the fourth area 540 on the map 500 of the tunnel construction site.

In an embodiment, information about a danger zone may be indicated on the map 500 of the tunnel construction site. For example, the server 200 may determine that the third area 3 of the tunnel construction site is a danger zone. In this case, the third area 530 on the map 500 of the tunnel construction site may be marked as the danger zone. The third area 530 on the map 500 of the tunnel construction site may be indicated in a color different from those of other multiple areas. The method for displaying the danger zone is not especially limited.

In an embodiment, the server 200 may check information about workers and pieces of equipment located in the third area 3, which is the danger zone. The server 200 may send a warning message to the workers located in the third area 3. The server 200 may check whether the workers located in the third area 3 have been authorized to enter and exit the danger zone. If it is determined that a worker unauthorized to enter and exit the danger zone is located in the danger zone, the server 200 may send a message notifying the unauthorized worker that he or she should leave the danger zone, and may send a message to the worker terminals of other workers located at the tunnel construction site or the manager terminal of the safety manager of the tunnel construction site.

Figure 4:
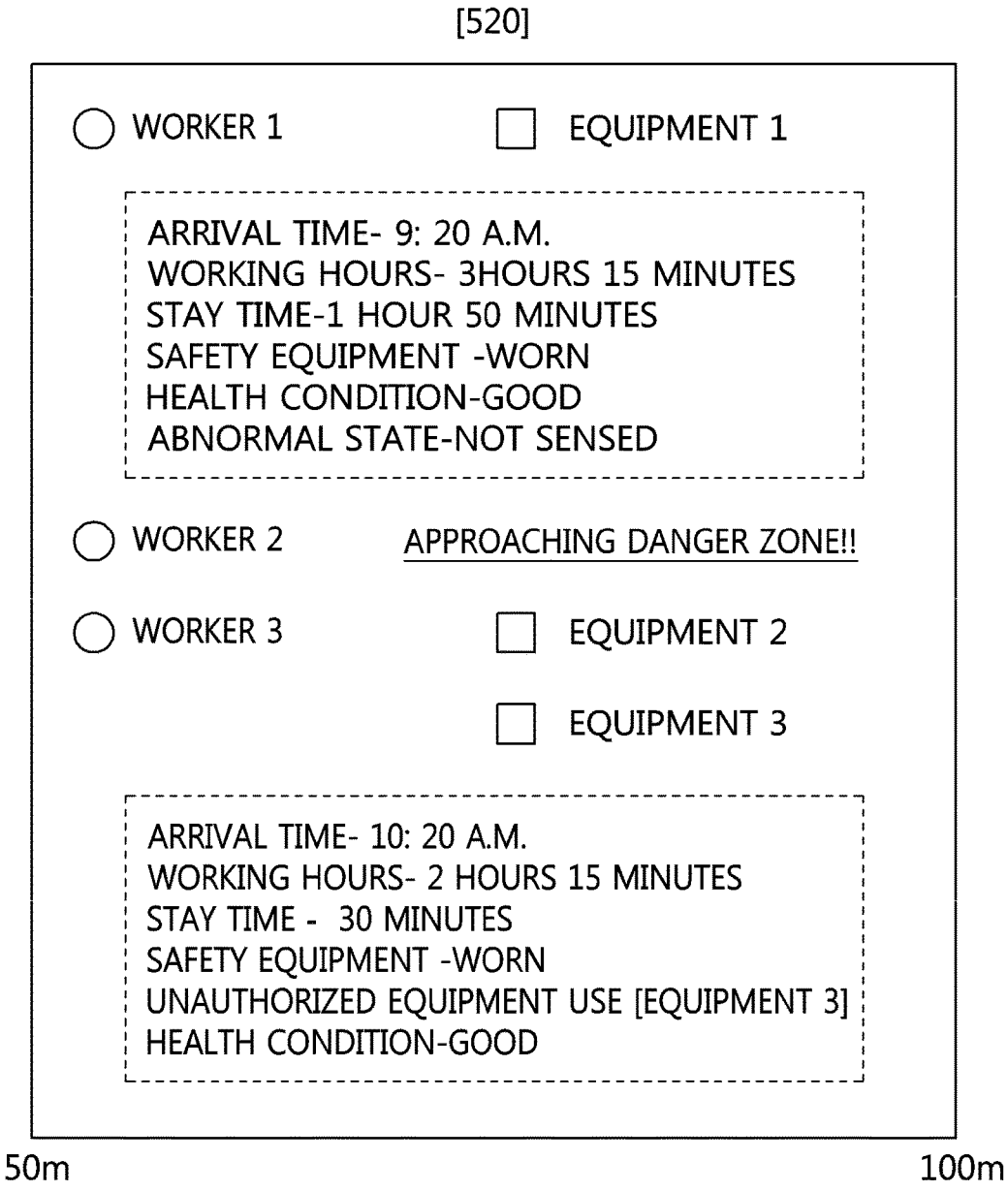
FIG. 4 is a diagram illustrating a detailed example in which information about workers and pieces of equipment is displayed on the map of the tunnel construction site, illustrated in FIG. 3.

FIG. 4 is a diagram illustrating a detailed example in which information about workers and pieces of equipment is displayed on the map of the tunnel construction site, illustrated in FIG. 3.

Referring to FIG. 4, the second area 520 on the map 500 of the tunnel construction site illustrated in FIG. 3 is depicted. Referring to FIG. 4, information about workers 1 to 3 and pieces of equipment 1 to 3 is displayed in the second area 520 on the map 500 of the tunnel construction site.

In an embodiment, information about workers and information about equipment may be sorted and separately displayed on the map 500 of the tunnel construction site. For example, information about workers may be displayed on the left side, and information about equipment may be displayed on the right side. In this case, pieces of equipment determined to be used by respective workers may be displayed on the right sides of the respective workers. For example, it may be determined that worker 1 is using equipment 1. In this case, equipment 1 may be displayed on the right side of the worker 1.

In an embodiment, information about each worker may contain information about the time of arrival, working hours, the time spent (stay time) in each area, wearing or non-wearing of safety equipment, health condition, and other abnormal states. In an embodiment, the equipment 1 illustrated in FIG. 4 may be safety equipment to be worn by the worker 1 at the tunnel construction site. In this case, the server 200 may determine that the worker 1 wears the safety equipment, and may indicate that the worker 1 wears the safety equipment in the second area 520 on the map 500 of the tunnel construction site.

In an embodiment, when the worker 2 is approaching the third area 3, which is the danger zone, the server 200 may display a warning message in the second area 520 on the map 500 of the tunnel construction site. For example, a warning message indicating that the second worker is approaching the danger zone may be displayed on the right side of the second worker displayed in the second area 520.

Referring to FIG. 4, equipment 2 and equipment 3 may be displayed on the right side of the worker 3. The equipment 2 may be safety equipment to be worn by the worker 3. Information indicating that the worker 3 is wearing the safety equipment may be displayed in the second area 520. The equipment 3 may be equipment requiring authorization in order to be used. The worker 3 may be unauthorized to use the equipment 3. In this case, information indicating that the worker 3 is using equipment without authorization may be displayed in the second area 520.

Figure 5:
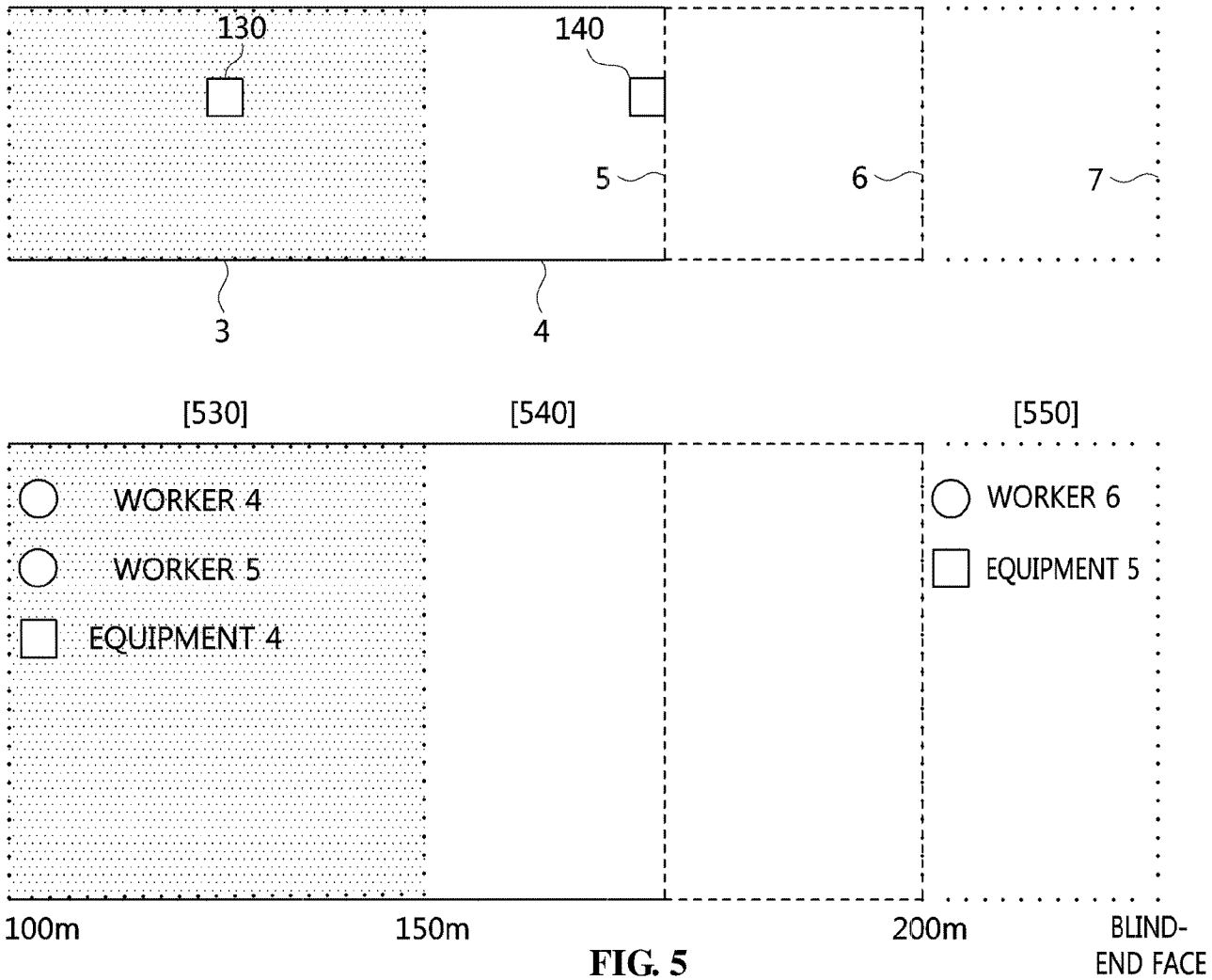
FIG. 5 is a diagram illustrating an example in which a map of a tunnel construction site is displayed in consideration of changes in the tunnel construction site.

FIG. 5 is a diagram illustrating an example in which a map of a tunnel construction site is displayed in consideration of changes in the tunnel construction site.

At the tunnel construction site, a blind-end face 5 is present. However, the blind-end face may continuously retreat due to the characteristics of the tunnel construction site. In addition to the blind-end face, the topography of the tunnel construction site may continuously change, and a new space may appear or disappear.

In FIG. 5, an example of a method for displaying the map 500 of the tunnel construction site when the blind-end face 5 retreats is illustrated. However, the method illustrated in FIG. 5 may also be applied to a change in any space appearing at the tunnel construction site.

In an embodiment, an information collection terminal 140 may be installed on the blind-end face 5. The blind-end face 5 may disappear, and a new blind-end face 6 may be formed due to tunnel construction. In this case, the space between the existing blind-end face 5 and the new blind-end face 6 may fall within the signal reception range of the information collection terminal 140. In an embodiment, a sensor for determining the location of each object near the information collection terminal 140 may be included in the information collection terminal 140. In this case, the information collection terminal 140 may recognize that a new space is formed at the location where the existing blind-end face 5 was present. In this case, the range of the fourth area 540 on the map 500 of the tunnel construction site may be extended and displayed.

In an embodiment, the blind-end face 6 may retreat, and then a new blind-end face 7 may be formed. In this case, the space between the existing blind-end face 6 and the new blind-end face 7 may fall out of the signal reception range of the information collection terminal 140. If the worker 6 present in the fourth area 4 wears equipment 5 and then moves to a region near the new blind-end face 7, signals that were received from the beacon terminals of the worker 6 and the equipment 5 may no longer be received by the information collection terminal 140. Further, signals from the beacon terminals of the worker 6 and the equipment 5 may be received by none of the information collection terminals 110 to 140.

In this case, the server 200 may determine that the blind-end face has retreated and the new space has been formed, and that the worker 6 and the equipment 5 are located in the new space. The server 200 may generate and display a fifth area 550 corresponding to the new space on the map 500 of the tunnel construction site. Further, it may be displayed that the worker 6 and the equipment 5 are located in the fifth area 550. Further, the server 200 may display a notification indicating that an additional information collection terminal is to be installed in the new area.

Figure 6:
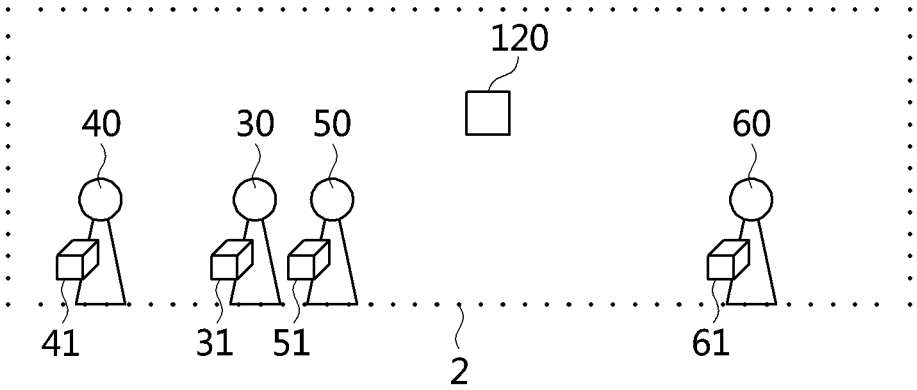
FIG. 6 is a diagram illustrating an example of a method for generating groups of workers according to an embodiment.
Figure 6:
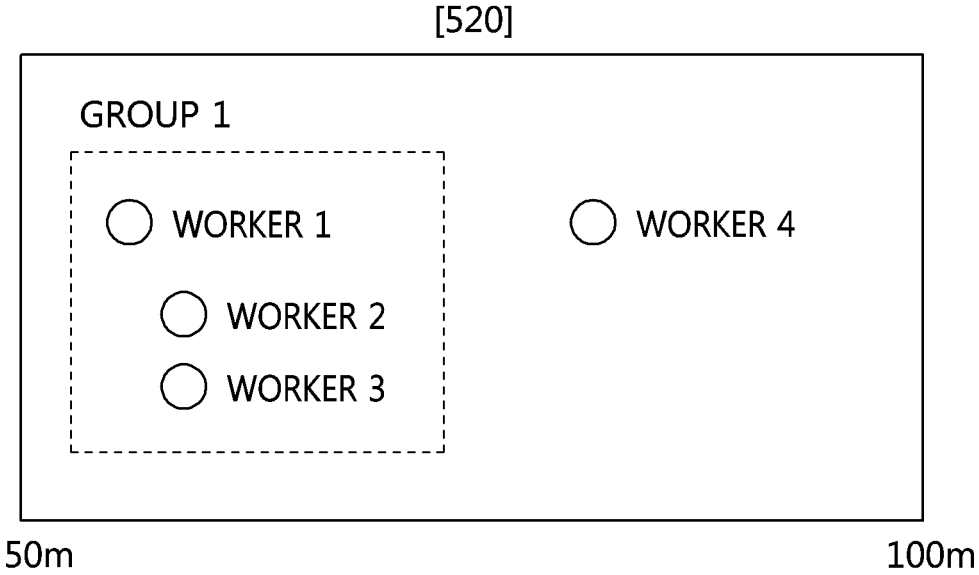

FIG. 6 is a diagram illustrating an example of a method for generating groups of workers according to an embodiment.

In an embodiment, the server 200 may generate a group of workers located in the same area, among multiple areas of the tunnel construction site, and may decide on a representative worker of the group.

Each of the worker terminals which are used by respective workers may further include a short-range communication module that enables communication between individual worker terminals. Each of the worker terminals may transmit information about one or more worker terminals, located within a distance enabling communication, to the server 200 through the information collection terminal.

The server 200 may decide on a representative worker of each group, and may receive information about other workers included in the corresponding group from the worker terminal of the representative worker. Other workers included in the information received from the worker terminal of the representative worker may be determined to be located near the representative worker. Since pieces of information about respective workers are managed as a group rather than being individually received, management may be facilitated, and an error that may occur while one information collection terminal is receiving information from multiple worker terminals may be prevented.

In an embodiment, even in the same area, one or more groups may be formed depending on the locations of respective workers. The server 200 may generate group 1 including worker 130, worker 2 40, and worker 3 50, who are located closer to each other in the second area 2 of the tunnel construction site. In an embodiment, the worker 1 30, worker 2 40, and worker 3 50 may be located at distance at which they are capable of performing short-range communication with each other using their worker terminals 31 to 51. The server 200 may select the worker 1 30 as a representative worker of the group 1.

Information about the group 1 and workers included in the group 1 may be displayed in the second area 520 on the map 500 of the tunnel construction site. Also, information about worker 4 60, who is not included in the group 1, may be displayed.

The worker terminal 31 of the worker 1 30 may receive information from the worker terminals 41 and 51 of the worker 2 40 and worker 3 50, and may transfer the received information to the server 200. The server 200 may determine, based on the information received from the worker terminal 31 of the worker 1 30, that the worker 2 40 and the worker 3 50 are located near the worker 1 30.

In an embodiment, members in the group may be changed. For example, the worker 4 60 may move to an area near the worker 1 30, and thus information about the worker 4 60 may be transferred from the worker terminal 31 of the worker 1 30 to the server 200. In this case, the server 200 may add the worker 4 60 to the group 1.

Further, the worker 4 60 may again be far away from the worker 1 30. When information about the worker 4 60 is not further received from the worker terminal 31 of the worker 1 30, the server 200 may exclude the worker 4 60 from the group 1, and may determine the location of the worker 4 60 by receiving information from the worker terminal 61 of the worker 4 60.

Figure 7:
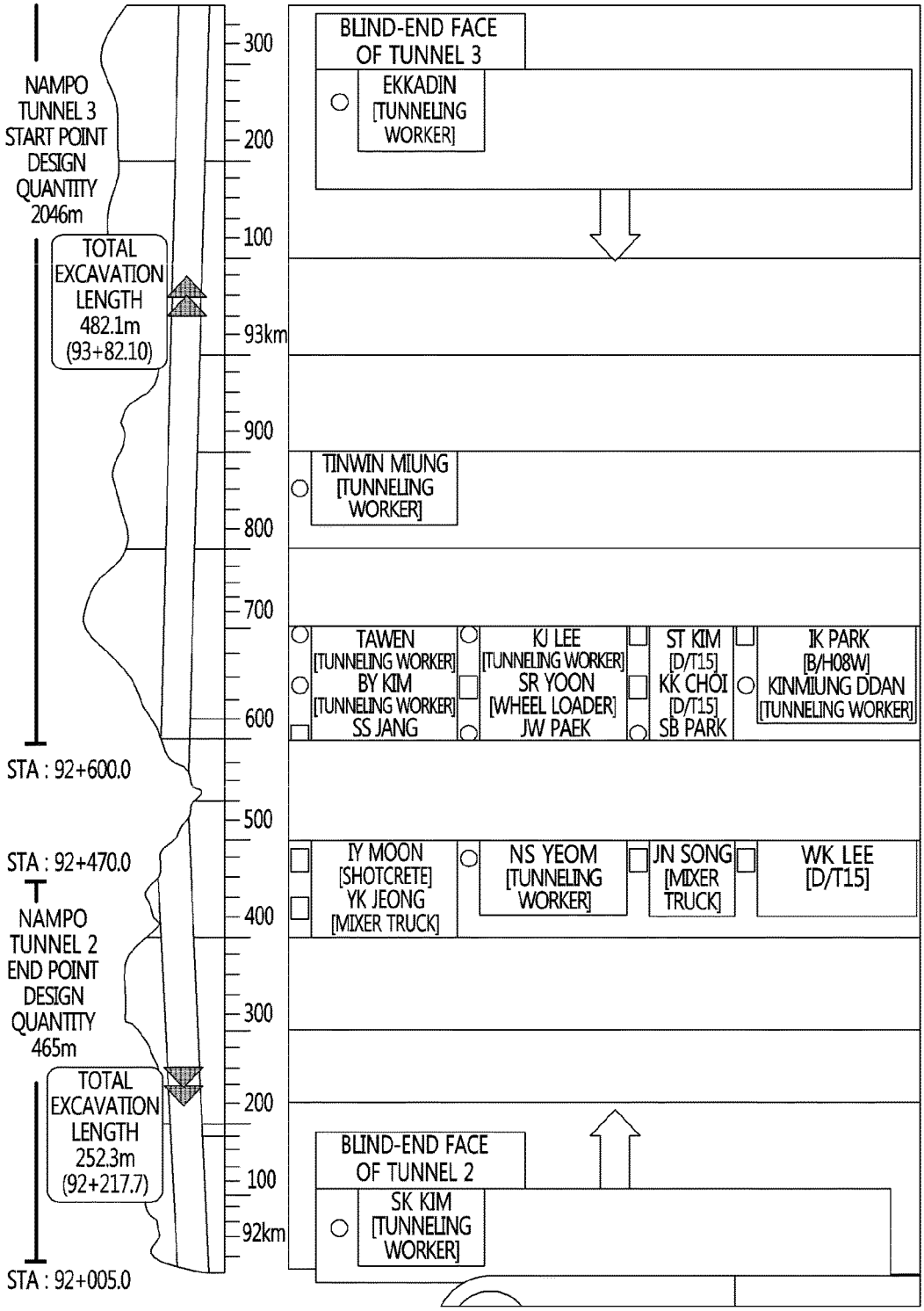
FIG. 7 is a diagram illustrating an example of an actual execution screen of a safety management system for a worker at a tunnel construction site.

FIG. 7 is a diagram illustrating an example of an actual execution screen of the safety management system for a worker at a tunnel construction site. The screen illustrated in FIG. 7 may be the map of the tunnel construction site shown in FIG. 3. FIG. 7 is a diagram illustrating an example of the actual execution screen in the method for displaying the map of the tunnel construction site illustrated in FIGS. 3 to 6.

Referring to FIG. 7, two tunnel construction sites are illustrated. Further, each of the two tunnel construction sites is divided into multiple areas and then displayed, and respective blind-end faces of the two tunnel construction sites are depicted. Also, information about workers located in each of the multiple areas is displayed.

The steps of the method or the algorithm described in relation to the embodiments of the present invention may be directly implemented by hardware, a software module executed by the hardware, or a combination thereof. The software module may reside in Random Access Memory (RAM), Read-Only Memory (ROM), Erasable Programmable ROM (EPROM), Electrically Erasable Programmable ROM (EEPROM), flash memory, a hard disk, a removable disk, Compact Disk ROM (CD-ROM) or any type of computer-readable storage medium that is well-known to those skilled in the art to which the present invention pertains.

Although the embodiments of the present invention have been described with reference to the attached drawings, those skilled in the art to which the present invention pertains will understand that the present invention may be practiced in other detailed forms without departing from the technical spirit or essential features of the invention. Therefore, it should be understood that the above-described embodiments are exemplary in all aspects rather than being restrictive.

The invention claimed is:

1. A safety management system for a worker at a tunnel construction site, comprising:

a server configured to control the safety management system;

routers installed at regular intervals at the tunnel construction site;

a worker terminal carried by the worker;

an equipment terminal carried by equipment used for tunnel construction; and one or more information collection terminals configured to receive worker information from the worker terminal, collect environmental information of the tunnel construction site, and transfer the environmental information to the server, wherein the server determines a location of the worker using the worker information, divides a map of the tunnel construction site into multiple areas, displays the multiple areas on a browser, displays the worker information in an area in which the worker is located, among the multiple areas, and sets at least one danger zone based on the environmental information and previously input risk factors, wherein the one or more information collection terminals receive equipment information from the equipment terminal and transfer the equipment information to the server, and wherein the server determines a location of the equipment using the equipment information and generates information about equipment being used by the worker using the location of the worker and the location of the equipment.

2. The safety management system of claim 1, wherein the one or more information collection terminals are installed at predetermined intervals from an entrance of the tunnel construction site to a blind-end face of the tunnel construction site, and are additionally installed between the predetermined intervals when a tunnel face of the tunnel construction site or an obstacle is located between the predetermined intervals.

3. The safety management system of claim 1, wherein the server divides the map of the tunnel construction site into multiple areas around the one or more information collection terminals, displays the multiple areas on the browser, and displays the worker information in an area around the information collection terminal that has received the worker information, among the multiple areas.

4. The safety management system of claim 1, further comprising a manager terminal carried by a safety manager of the tunnel construction site, wherein the manager terminal displays the browser.

5. The safety management system of claim 1, wherein the server is configured to:

determine an arrival time of the worker and a departure time of the worker using worker information received by an information collection terminal installed at an entrance of the tunnel construction site, and determine a start time and an end time of use of the equipment using equipment information received by the information collection terminal installed at the entrance of the tunnel construction site.

6. The safety management system of claim 5, wherein the server is configured to:

determine, using information about the equipment being used by the worker, whether the worker wears safety equipment and whether the worker using the equipment is authorized to use the equipment, determine whether the worker enters and exits the danger zone, and determine whether the worker complies with safety regulations based on the arrival time and the departure time of the worker and determination of whether the worker wears the safety equipment, whether the worker is authorized to use the equipment, and whether the worker enters and exits the danger zone.

7. The safety management system of claim 1, wherein the server is configured to update, in real time, information about the at least one set danger zone using the environmental information, the worker information, and information about accidents or problems occurring in each of the multiple areas.

8. A safety management system for a worker at a tunnel construction site, comprising:

a server configured to control the safety management system;

routers installed at regular intervals at the tunnel construction site;

a worker terminal carried by the worker; and one or more information collection terminals configured to receive worker information from the worker terminal, collect environmental information of the tunnel construction site, and transfer the environmental information to the server, wherein the server determines a location of the worker using the worker information, divides a map of the tunnel construction site into multiple areas, displays the multiple areas on a browser, displays the worker information in an area in which the worker is located, among the multiple areas, and sets at least one danger zone based on the environmental information and previously input risk factors, wherein the server is configured to, when it is not possible to determine the location of the worker:

determine a last area in which the worker was located, among the multiple areas, generate and display a new area adjacent to the last area in which the worker was located, and display the worker information in the new area.

9. A safety management system for a worker at a tunnel construction site, comprising:

a server configured to control the safety management system;

routers installed at regular intervals at the tunnel construction site;

a worker terminal carried by the worker; and one or more information collection terminals configured to receive worker information from the worker terminal, collect environmental information of the tunnel construction site, and transfer the environmental information to the server, wherein the server determines a location of the worker using the worker information, divides a map of the tunnel construction site into multiple areas, displays the multiple areas on a browser, displays the worker information in an area in which the worker is located, among the multiple areas, and sets at least one danger zone based on the environmental information and previously input risk factors, wherein:

the worker terminal further comprises a short-range communication module that enables communication between individual worker terminals, and transfers information about one or more nearby workers, received by the short-range communication module, to a corresponding information collection terminal, and the server generates a group including the worker and one or more additional workers located near the worker using the information about the one or more nearby workers, received by the short-range communication module, and determines locations of the one or more additional workers belonging to the group based on the location of the worker and the information about the one or more nearby workers.

* * * * *